US011325144B2

(12) United States Patent
Shazuki

(10) Patent No.: US 11,325,144 B2
(45) Date of Patent: May 10, 2022

(54) TRIGGER-TYPE PUMP DISPENSER

(71) Applicant: CANYON CORPORATION, Tokyo (JP)

(72) Inventor: Mitsuaki Shazuki, Onoda (JP)

(73) Assignee: CANYON CORPORATION, Tokyo (JP)

( * ) Notice: Subject to any disclaimer, the term of this patent is extended or adjusted under 35 U.S.C. 154(b) by 0 days.

(21) Appl. No.: 17/273,414

(22) PCT Filed: Sep. 5, 2019

(86) PCT No.: PCT/JP2019/035082
§ 371 (c)(1),
(2) Date: Mar. 4, 2021

(87) PCT Pub. No.: WO2020/054586
PCT Pub. Date: Mar. 19, 2020

(65) Prior Publication Data

US 2021/0323014 A1 Oct. 21, 2021

(30) Foreign Application Priority Data

Sep. 11, 2018 (JP) ..... JP2018-170112

(51) Int. Cl.
*B05B 11/00* (2006.01)

(52) U.S. Cl.
CPC ..... *B05B 11/3097* (2013.01); *B05B 11/3011* (2013.01)

(58) Field of Classification Search
CPC . B05B 11/3097; B05B 11/3011; B05B 15/30; B05B 11/0064; B05B 11/0075;
(Continued)

(56) References Cited

U.S. PATENT DOCUMENTS 1,937,344 A * 11/1933 Hollingsworth .... B05B 11/3014 222/385
3,877,616 A * 4/1975 Stevens ..... B05B 11/3001 222/321.9

(Continued)

FOREIGN PATENT DOCUMENTS

JP 2016-64835 A 4/2016

OTHER PUBLICATIONS

English translation of International Search Report of PCT/JP2019/035082 dated Oct. 8, 2019.

*Primary Examiner* — Vishal Pancholi
(74) *Attorney, Agent, or Firm* — Muncy, Geissler, Olds & Lowe, P.C.

(57) ABSTRACT

[Object] To provide a trigger-type pump dispenser that makes it possible to prevent an out-of-nozzle squirting phenomenon that occurs at a final stage of sucking up of liquid out of a vessel into a cylinder.

[Solution] A trigger-type pump dispenser A includes a handle structure 1, a nozzle base structure 2 attached to the handle structure 1, a trigger 3, a cylinder structure 4, a cap 5 by which the cylinder structure 4 is held down and attached to the mouth of a vessel, a piston structure 6 that slides inside the cylinder structure 4, an inverted-mortar-shaped lip 61 formed in the piston structure 6, a spring 7 that springs the piston structure 6, a valve case 8 attached to the nozzle base structure 2, a mortar-shaped valve seat 81 formed in the valve case 8, a leak valve 9, attached to a bottom part of the cylinder structure 4, that has a bulging portion 91 at a tip thereof, a first valve FV, and a second valve SV. A movement of the piston structure 6 from top dead center to bottom dead center causes liquid in the cylinder structure 4 to be discharged from a nozzle orifice N. The bulging portion 91 at the tip of the leak valve 9 is disposed to pass through the inverted-mortar-shaped lip 61.

(Continued)

A through-hole diameter D1 of the mortar-shaped valve seat 81 of the valve case 8 is smaller than a nozzle orifice diameter D2.

5 Claims, 5 Drawing Sheets

(58) Field of Classification Search
CPC . B05B 11/3047; B05B 11/3094; B05B 15/63; F04B 13/00; F04B 23/08; F04B 9/14
USPC ..... 222/401
See application file for complete search history.

(56) References Cited

U.S. PATENT DOCUMENTS

| | | | | | |
|---|---|---|---|---|---|
| 4,061,250 | A * | 12/1977 | Tada | B05B 11/3014 | 222/321.8 |
| 4,186,855 | A * | 2/1980 | Edman | B05B 11/3057 | 222/321.8 |
| 5,219,098 | A * | 6/1993 | Tada | B05B 11/3001 | 222/153.06 |
| 10,046,349 | B2 * | 8/2018 | Tada | F04B 9/14 | |
| 2004/0182884 | A1 * | 9/2004 | Tada | B05B 11/3057 | 222/153.13 |
| 2014/0061252 | A1 * | 3/2014 | Sweeton | B67D 7/60 | 222/321.8 |
| 2017/0209883 | A1 * | 7/2017 | Tada | B05B 11/3057 | |
| 2017/0291184 | A1 * | 10/2017 | Tada | F04B 9/14 | |
| 2018/0185866 | A1 * | 7/2018 | Tada | B05B 11/3059 | |

* cited by examiner

TRIGGER-TYPE PUMP DISPENSER

TECHNICAL FIELD

The present invention relates to trigger-type pump dispensers that make it possible to avoid squirting phenomena and, in particular, to a trigger-type pump dispenser that makes it possible to avoid an out-of-nozzle squirting phenomenon that occurs at a final stage when liquid is sucked up by operation of a trigger.

BACKGROUND ART

Conventionally, trigger-type pump dispensers have been widely used for discharging or ejecting liquid out of vessels to which they are attached.

These trigger-type pump dispensers usually include a piston and a cylinder, and cause liquid to be ejected from a nozzle by moving the piston to apply pressure to the inside of the cylinder.

These trigger-type pump dispensers are categorized into types according to how the piston is moved. An example of the types is a trigger-type pump dispenser formed such that liquid is discharged from a nozzle with its handle held by four fingers and with its trigger pulled down by a thumb (see PTL 1).

This trigger-type pump dispenser disclosed in PTL 1 is intended to discharge liquid out from a nozzle portion by depressing the piston in tandem with a movement of the trigger to apply pressure to the liquid in the cylinder.

However, on the other hand, this trigger-type pump dispenser suffers from a problem called "squirting phenomenon" that occurs immediately before the piston reaches top dead center during an operation in which the piston rises and sucks up the liquid out of the vessel.

A reason for this is that since, immediately before the piston reaches top dead center, a lip formed in the piston moves while being crimped onto a tip of a leak valve attached to the cylinder, liquid charged between a valve case and the piston is subjected to pressure and instantaneously vigorously squirts out from the nozzle.

An inadvertent squirt of liquid makes its surroundings dirty, and such a squirting phenomenon must be avoided as much as possible.

CITATION LIST

Patent Literature

PTL 1: Japanese Patent Application Laid-Open No. 2016-64835

SUMMARY OF INVENTION

Technical Problem

The present invention was made on the basis of such background art.

That is, it is an object of the present invention to provide a trigger-type pump dispenser that makes it possible to prevent an out-of-nozzle squirting phenomenon that occurs at a final stage of sucking up of liquid out of a vessel into a cylinder.

Solution to Problems

The inventor diligently studied to solve the foregoing problems, found that the conventional problem, i.e. a squirting phenomenon, can be solved by setting a relationship between the nozzle orifice diameter of the nozzle portion and the through-hole diameter of a valve seat of the valve case to a certain condition, and, based on these findings, accomplished the present invention.

The present invention is directed to (1) a trigger-type pump dispenser A including: a handle structure 1; a nozzle base structure 2 attached to the handle structure 1; a trigger 3 attached to the handle structure 1; a cylinder structure 4 attached to the handle structure 1; a cap 5 by which the cylinder structure 4 is held down and attached to a mouth of a vessel; a piston structure 6 that slides inside the cylinder structure 4; an inverted-mortar-shaped lip 61 formed in the piston structure 6; a spring 7 that springs the piston structure 6; a valve case 8 attached to the nozzle base structure 2; a mortar-shaped valve seat 81 formed in the valve case 8; a leak valve 9, attached to a bottom part of the cylinder structure 4, that has a bulging portion 91 at a tip thereof; a first valve FV; and a second valve SV, wherein a movement of the piston structure 6 from top dead center to bottom dead center causes liquid in the cylinder structure 4 to be discharged from a nozzle orifice N, the bulging portion 91 at the tip of the leak valve 9 is disposed to pass through the inverted-mortar-shaped lip 61, and a through-hole diameter D1 of the mortar-shaped valve seat 81 of the valve case 8 is smaller than a nozzle orifice diameter D2.

The present invention is directed to (2) the trigger-type pump dispenser A according to (1) described above, wherein the inverted-mortar-shaped lip 61 is set to be crimped onto the bulging portion 91 at the tip of the leak valve 9 immediately before the piston structure 6 reaches top dead center.

The present invention is directed to (3) the trigger-type pump dispenser A according to (1) described above, wherein Through-hole diameter D1<Nozzle orifice diameter D2, D1 ranges from 2 mm to 6 mm, and D2 ranges from 3 mm to 8 mm.

The present invention is directed to (4) the trigger-type pump dispenser A according to (1) described above, wherein a conduit 10 is attached to a lower part of a small-diameter cylinder portion 4B of the cylinder structure 4, and an adaptor 12 is attached to a lower end of the conduit 10 by press fitting.

The present invention is directed to (5) the trigger-type pump dispenser A according to (4) described above, wherein the adaptor 12 is a tubular body and has provided therein a thick bottom wall 12B having a bottom hole 12A, and the thick bottom wall 12B has a slope at a lower end thereof.

It should be noted that a configuration based on a proper combination of elements of the invention described above can be employed, provided such a configuration does not depart from the object of the present invention.

Advantageous Effects of Invention

A trigger-type pump dispenser according to the present invention has the following effects.

Since the present invention is directed to a trigger-type pump dispenser A including: a handle structure 1; a nozzle base structure 2 attached to the handle structure 1; a trigger 3 attached to the handle structure 1; a cylinder structure 4 attached to the handle structure 1; a cap 5 by which the cylinder structure 4 is held down and attached to a mouth of a vessel; a piston structure 6 that slides inside the cylinder structure ; an inverted-mortar-shaped lip 61 formed in the piston structure 6; a spring 7 that springs the piston structure 6; a valve case 8 attached to the nozzle base structure 2; a mortar-shaped valve seat 81 formed in the valve case 8; a leak valve 9, attached to a bottom part of the cylinder structure 4, that has a bulging portion 91 at a tip thereof; a first valve FV; and a second valve SV, wherein a movement of the piston structure 6 from top dead center to bottom dead center causes liquid in the cylinder structure 4 to be discharged from a nozzle orifice N, the bulging portion 91 at the tip of the leak valve 9 is disposed to pass through the inverted-mortar-shaped lip 61, and a through-hole diameter D1 of the mortar-shaped valve seat 81 of the valve case 8 is smaller than a nozzle orifice diameter D2, the present invention prevents a squirting phenomenon from occurring from the nozzle orifice N.

Since the inverted-mortar-shaped lip 61 is set to be crimped onto the bulging portion 91 at the tip of the leak valve 9 immediately before the piston structure 6 reaches top dead center, the present invention can prevent the liquid from leaking due to vibration or the like even in a non-use time during which the trigger is at top dead center.

Since Through-hole diameter D1<Nozzle orifice diameter D2, D1 ranges from 2 mm to 6 mm, and D2 ranges from 3 mm to 8 mm, the present invention has a degree of freedom in design with which a squirting phenomenon can be prevented.

Since a conduit 10 is attached to a lower part of a small-diameter cylinder portion 4B of the cylinder structure 4 and an adaptor 12 is attached to a lower end of the conduit 10 by press fitting, the present invention prevents the liquid from dripping from the conduit 10 by flowing back even in case of removal from the vessel for liquid replenishment or the like, and does not make its surroundings dirty.

Further, simple assembling is attained.

Since the adaptor 12 is a tubular body and has provided therein a thick bottom wall 12B having a bottom hole 12A and the thick bottom wall 12B has a slope at a lower end thereof, the present invention can efficiently suck up the liquid to the last drop even when the conduit bends in the middle.

DESCRIPTION OF EMBODIMENTS

A trigger-type pump dispenser A according to an embodiment of the present invention is described below with reference to the drawings.

A trigger-type pump dispenser A according to an embodiment of the present invention is structured such that liquid is ejected from a nozzle portion 2A by applying a compressive force to the liquid by moving down a piston structure 6 by depressing a thumb supporting portion 32 of a trigger 3 downward with a thumb while holding an inverted-L-shaped handle portion 1A.

Figure 1:
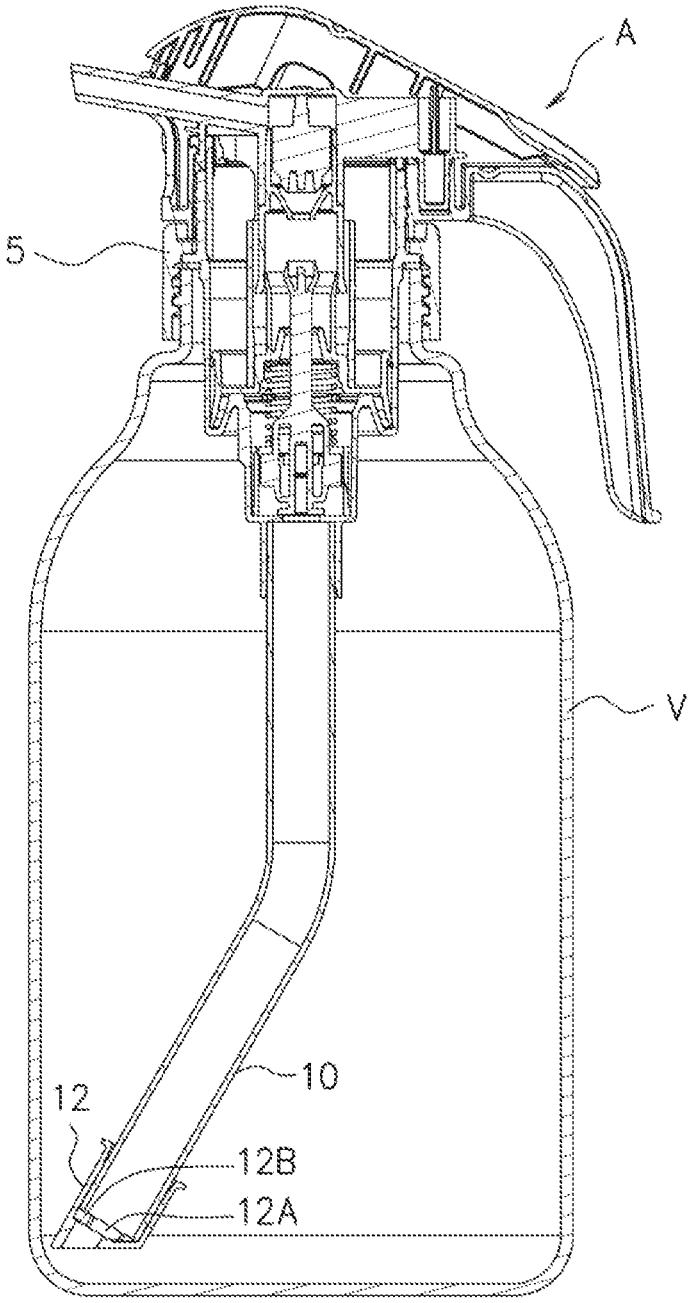
FIG. 1 shows a state in which a trigger-type pump dispenser A according to an embodiment of the present invention is attached to a vessel V.

FIG. 1 shows a state in which a trigger-type pump dispenser A according to an embodiment of the present invention is attached to a vessel.

In this state, an adaptor 12 is attached to a conduit 10.

As shown in FIG. 1, the trigger-type pump dispenser A of the present invention is usually attached to a vessel for use.

Figure 2:
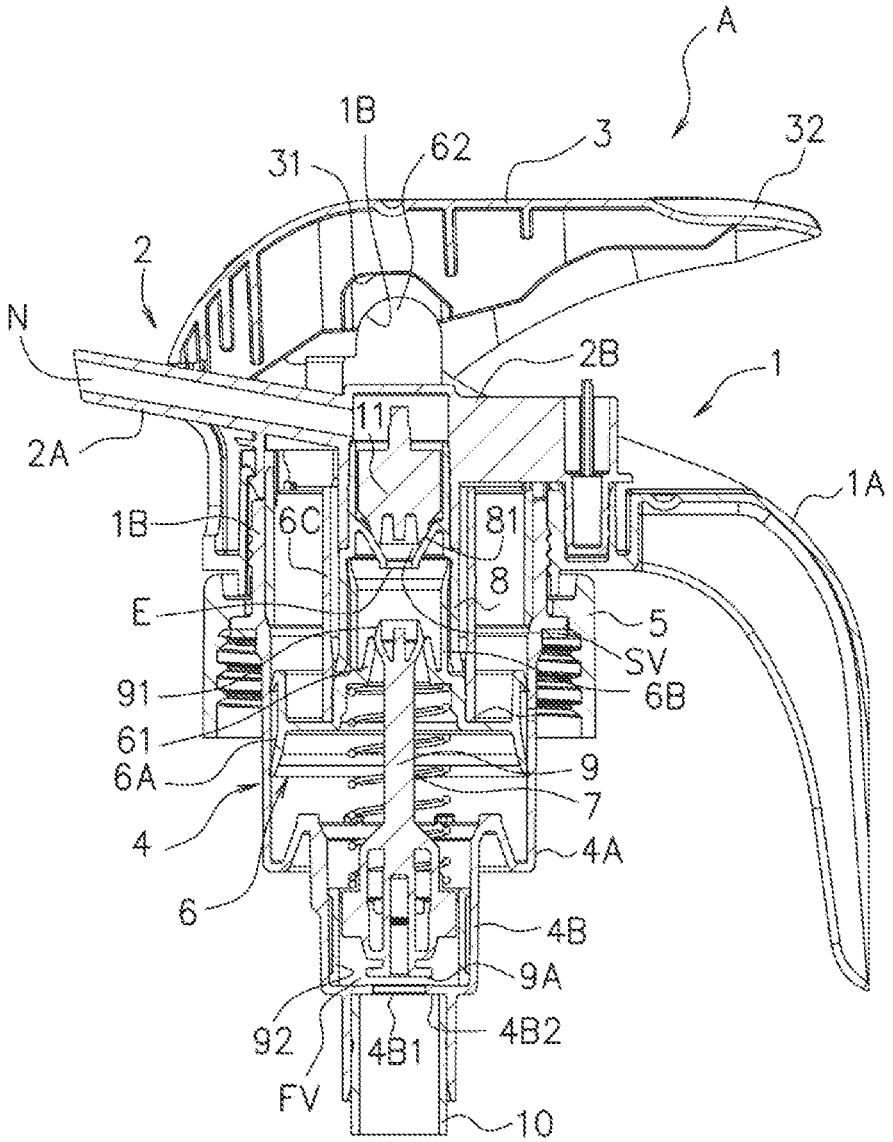
FIG. 2 is a longitudinal sectional view of the trigger-type pump dispenser A of the present invention in a top dead center position.
Figure 3:
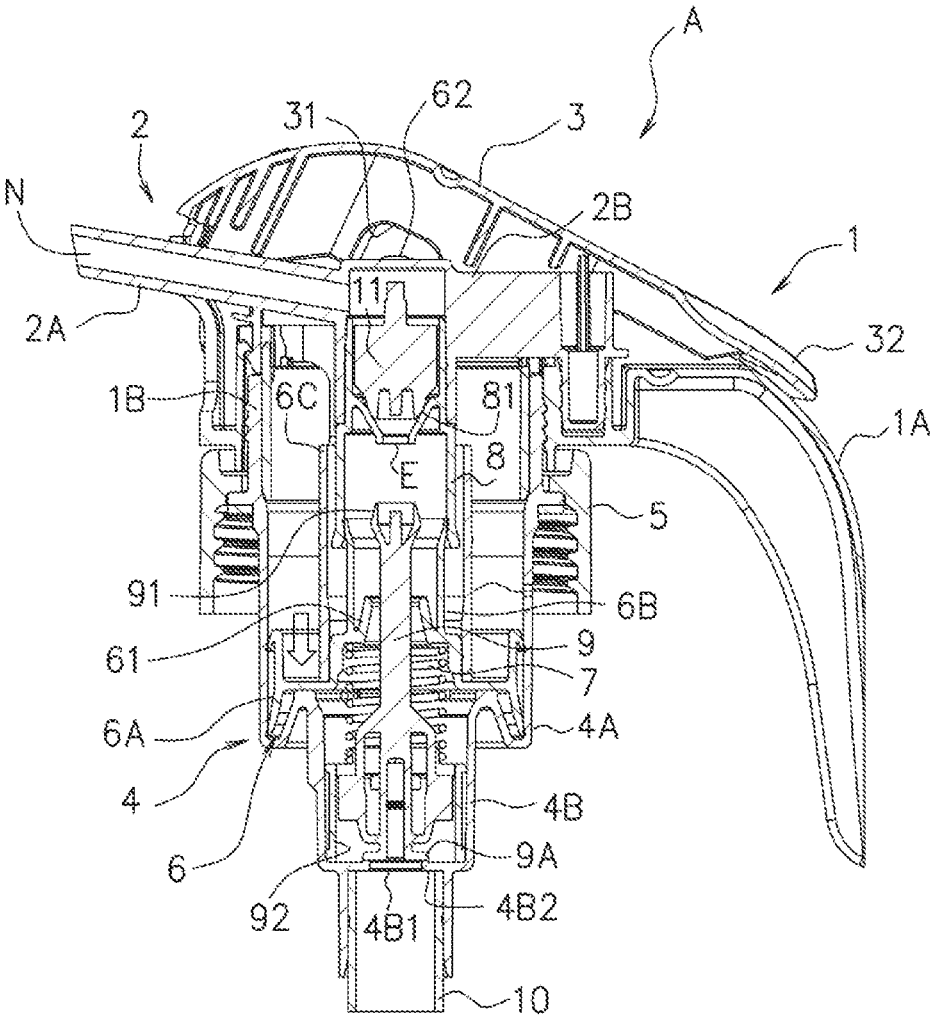
FIG. 3 is a longitudinal sectional view of the trigger-type pump dispenser A of the present invention in a bottom dead center position.

FIG. 2 is a longitudinal sectional view of the trigger-type pump dispenser A of the present invention in a top dead center position, and FIG. 3 is a longitudinal sectional view of the trigger-type pump dispenser A of the present invention in a bottom dead center position.

As can been seen from the drawings, the trigger-type pump dispenser A of the present invention includes a handle structure 1, a nozzle base structure 2 attached to the handle structure 1, a trigger 3 attached to the handle structure, a cylinder structure 4 attached to the handle structure 1, a cap 5 by which the cylinder structure 4 is held down and attached to the mouth of a vessel, a piston structure 6 that slides inside the cylinder structure 4, an inverted-mortar-shaped lip 61 formed in the piston structure 6, a spring 7 that springs the piston structure 6, a valve case 8 attached to the nozzle base structure 2, a mortar-shaped valve seat 81 formed in the valve case 8, and a leak valve 9, attached to a bottom part of the cylinder structure 4, that has a bulging portion 91 at a tip thereof.

Further, a conduit 10 is attached to a lower part of the cylinder structure 4. A first valve FV is provided between the conduit 10 and the cylinder structure 4, and a second valve SV is provided between the cylinder structure 4 and the nozzle base structure 2.

A movement of the piston structure 6 from top dead center to bottom dead center by operation of the trigger 3 causes liquid in the cylinder structure 4 to be discharged from a nozzle orifice N.

A structure of the trigger-type pump dispenser A thus configured is described below in more detail.

First, the handle structure 1 is composed of a handle portion 1A that is actually held by fingers and a basal portion 1B in which the nozzle base structure 2 and the cylinder structure 4 are fitted and mounted.

Moreover, the nozzle base structure 2 is attached to an upper part of the basal portion 1B by press fitting, and the cylinder structure 4 is attached to a lower part of the basal portion 1B by press fitting.

The nozzle base structure 2 includes a tubular basal portion 2B and a nozzle portion 2A extending forward from the tubular basal portion 2B.

Moreover, the after-mentioned second valve valving element 11, which serves as the second valve SV, is disposed in this tubular basal portion 2B.

The cylinder structure 4 includes a large-diameter cylinder portion 4A in which the piston structure 6 slides and a small-diameter cylinder portion 4B extended downward from the large-diameter cylinder portion 4A.

Further, the cylinder structure 4 has a projecting rib formed on an outer edge thereof, and the cylinder structure 4 is attached to the mouth of the vessel by pressing this projecting rib against the mouth of the vessel V with the cap 5, which is threadable.

In this way, the trigger-type pump dispenser A is easily attached to the vessel V by the cap 5.

Further, the piston structure 6 (in particular, a large-diameter piston portion 6A of the piston structure 6) is slidably disposed in the cylinder structure 4 (in particular, the large-diameter cylinder portion 4A of the cylinder structure 4).

The piston structure 6 includes the large-diameter piston portion 6A, a small-diameter piston portion 6B, and the inverted-mortar-shaped lip 61 (i.e. a truncated-cone-shaped lip 61), which protrudes from an inner root of the small-diameter piston portion 6B.

It should be noted that a piston shaft 6C is attached to the small-diameter piston portion 6B.

Further, the piston structure 6 is always biased by the spring 7 toward a higher position in the drawings, and turning the trigger 3 by depressing it downward causes the piston structure 6 to move downward against the biasing force of the spring 7.

The piston structure 6 has a columnar protrusion 62 provided at an upper end thereof, and this columnar protrusion 62 is in contact with a holding recessed portion 31, which is a part of the trigger 3.

Turning the trigger 3 with a depression pivot point as the fulcrum (It should be noted that the trigger 3 is pivotally attached to the handle structure 1) causes the columnar protrusion 62 to be depressed by the holding recessed portion 31, which is provided in an intermediate position in the trigger; therefore, according to the principle of leverage, the piston structure 6 moves down in a similar manner.

Meanwhile, the valve case 8 is attached to the nozzle base structure 2 by being inserted in the nozzle base structure 2 by press fitting.

This valve case 8 is formed in the shape of a cylinder, and has formed in an intermediate position therein the mortar-shaped valve seat 81 (i.e. an inverted-truncated-cone-shaped valve seat 81), which has a through-hole E.

The size (specifically, the through-hole diameter D1) of this through-hole E is set to be smaller than the nozzle orifice diameter D2 of the nozzle portion 2A. This point will be described later in detail.

Further, the small-diameter piston portion 6B, which is a part of the piston structure 6, is inserted in a lower part of the valve case 8.

In particular, a tip of the small-diameter piston portion 6B of this piston structure 6 can slide on an inner peripheral wall of this valve case 8.

That is, operating the trigger 3 so that it moves upward and downward causes the small-diameter piston portion 6B to slide upward and downward within the valve case 8.

Note here that a space surrounded by the valve case 8 and the small-diameter piston portion 6B communicates with internal spaces in the large-diameter cylinder portion 4A and the small-diameter cylinder portion 4B, which are lower parts of the cylinder structure 4, and the internal spaces further communicate with the conduit 10 and the inside of the vessel.

Further, the space surrounded by the valve case 8 and the small-diameter piston portion 6B also communicates with an internal space in the nozzle base structure 2.

The second valve valving element 11, which is configured to freely move up and down, is disposed above the mortar-shaped valve seat 81 in the valve case, and this second valve valving element 11 can move into contact with and away from the mortar-shaped valve seat 81 of the aforementioned valve case 8.

Moreover, in a state in which the second valve valving element 11 is away from the mortar-shaped valve seat 81, the space surrounded by the valve case 8 and the small-diameter piston portion 6B also communicates with the internal space in the nozzle base structure 2.

This second valve valving element 11 and the mortar-shaped valve seat 81 constitute the second valve SV.

Meanwhile, the leak valve 9, which is vertically elongated, is attached to the cylinder structure 4 (in particular, the small-diameter cylinder portion 4B of the cylinder structure 4), and this leak valve 9 has its tip expanded to serve as the bulging portion 91.

The tip extends upward through the inverted-mortar-shaped lip 61, which is formed in the small-diameter piston portion 6B (see FIG. 3).

Further, the inverted-mortar-shaped lip 61 is set to be crimped onto the bulging portion 91 at the tip of the leak valve 9 immediately before the piston structure 6 reaches top dead center (see FIG. 2).

It should be noted than a relationship between this bulging portion 91 and the inverted-mortar-shaped lip 61 will be described later. The leak valve 9 has its lower part attached to the small-diameter cylinder portion 4B of the cylinder structure 4 and enabled by a regulatory frame 92 to slightly move up and down a certain distance.

Note here that the small-diameter cylinder portion 4B has a lower hole 4B1 formed in a bottom part thereof and a lower valve seat 4B2 surrounding the lower hole 4B1.

The lower hole 4B1 can be closed by a bottom part 9A of the leak valve 9 making contact with the lower valve seat 4B2, and the lower hole 4B1 can be opened by the bottom part 9A moving away from the lower valve seat 4B2.

Accordingly, the bottom part 9A of the leak valve 9 and the lower valve seat 4B2 of the small-diameter cylinder portion constitute the first valve FV.

(Features)

The trigger-type pump dispenser A of the present invention is structured as described above. Features of the present invention are described here in more detail.

Now, applying pressure to liquid in the cylinder structure 4 by depressing the piston structure 6 through the operation of the trigger 3 causes the liquid subjected to the pressure to be discharged from the nozzle orifice N.

However, the liquid is subjected to high resistance in passing through the through-hole E (through-hole diameter D1) of the mortar-shaped valve seat 81.

Moreover, this resistance increases as the through-hoe diameter D1 decreases.

Just for reference, in terms of reducing the burden on a hand pulling the trigger 3, it is preferable that the through-hole diameter D1 be as large as possible.

Therefore, the through-hole diameter D1 has conventionally been as large as possible or, specifically, larger than the nozzle orifice diameter D2.

However, while increasing this through-hole diameter D1 surely reduces the burden on the hand, doing so causes the aforementioned problem called "squirting phenomenon" to occur at the nozzle orifice N immediately before the piston reaches top dead center.

The present invention was devised from the point of view of preventing a squirting phenomenon in exchange for the burden on a hand operating this trigger 3 and, contrary to the conventional technology, is configured such that the through-hole diameter D1 of the mortar-shaped valve seat 81 is smaller than the nozzle orifice diameter D2.

That is, Through-hole diameter D1<Nozzle orifice diameter D2.

When the through-hole diameter D1 is thus smaller than the nozzle orifice diameter D2, the liquid passes through the nozzle orifice N at a velocity which is lower than that at which the liquid passes through the through-hole E.

Further, the liquid is subjected to high resistance when passing through the through-hole E.

Therefore, this resistance puts a brake on the velocity at which the liquid passes through the through-hole E.

This results in putting a brake on the velocity at which the liquid exits from the nozzle orifice N, preventing the liquid from vigorously squirting, i.e. preventing a so-called squirting phenomenon.

Note here that from the point of view of resistance to passage of the liquid and prevention of a squirting phenomenon, it is preferable that a relationship between the through-hole diameter D1 and the nozzle orifice diameter D2 be such that D1 ranges from 2 mm to 6 mm and D2 ranges from 3 mm to 8 mm.

Since the settings can be configured within these ranges, there is a great degree of freedom in design with which a squirting phenomenon can be prevented.

Next, actions in the trigger-type pump dispenser A of the present invention are described.

First, assume that the trigger is at top dead center, that the piston structure 6 is at top dead center, too, and that the cylinder structure is filled with liquid (see FIG. 2).

Now, depressing the trigger 3 with a thumb or the like while holding the handle structure 1 with a hand causes the piston structure 6 to move down, so that pressure is applied to the liquid in the cylinder structure 4.

In this case, the first valve FV is closed, and the second valve SV is opened, so that the liquid passes through the nozzle base structure 2 and is discharged out from the nozzle orifice N of the nozzle base structure 2.

Then, once a certain amount of liquid is discharged, the trigger reaches bottom dead center, and similarly, the piston structure 6 reaches bottom dead center, too (see FIG. 3).

Next, the trigger is released from the hand.

Figure 4:
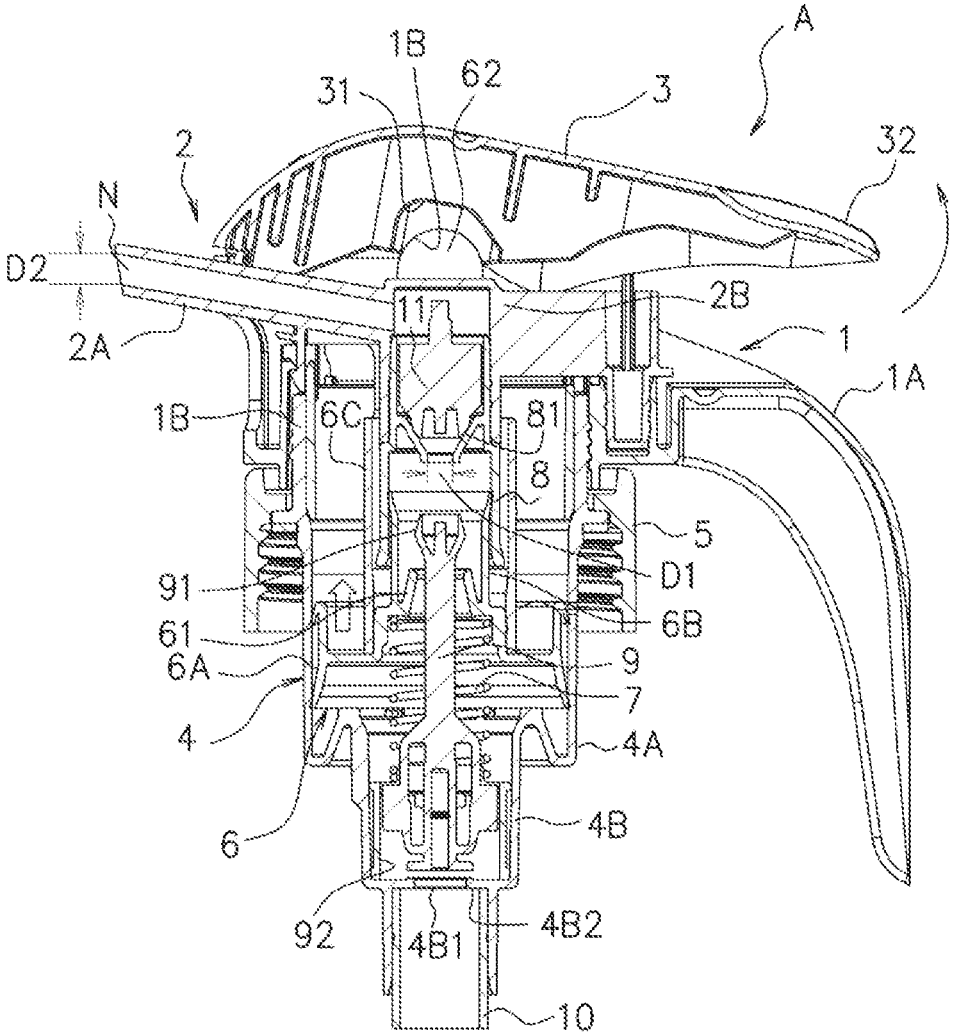
FIG. 4 is a longitudinal sectional view of the trigger-type pump dispenser A of the present invention in a median point position.

Then, in turn, the piston structure 6 moves upward with a resilient force of the spring 7, so that the pressure in the cylinder structure 4 becomes negative; therefore, the first valve FV is opened, and the second valve SV is closed, so that the liquid in the vessel V is sucked up into the cylinder structure 4 via the conduit 10 (see FIG. 4).

In particular, the second valve valving element 11 reaches into contact with the mortar-shaped valve seat 81 by moving down a certain distance from a state of being lifted open, with the result that the second valve SV is closed.

Then, the bottom part 9A of the leak valve 9 moves away from the valve seat 4B2 of the cylinder structure 4, so that the first valve FV is opened and the liquid is sucked up.

Then, when the liquid is sucked up from the vessel V into the cylinder structure 4 and the piston structure 6 comes to a final stage close to top dead center, the inverted-mortar-shaped lip 61 is crimped onto the bulging portion 91 at the expanded tip of the leak valve 9, so that upper and lower spaces bordering each other at the inverted-mortar-shaped lip 61 are sealed.

Figure 5A:
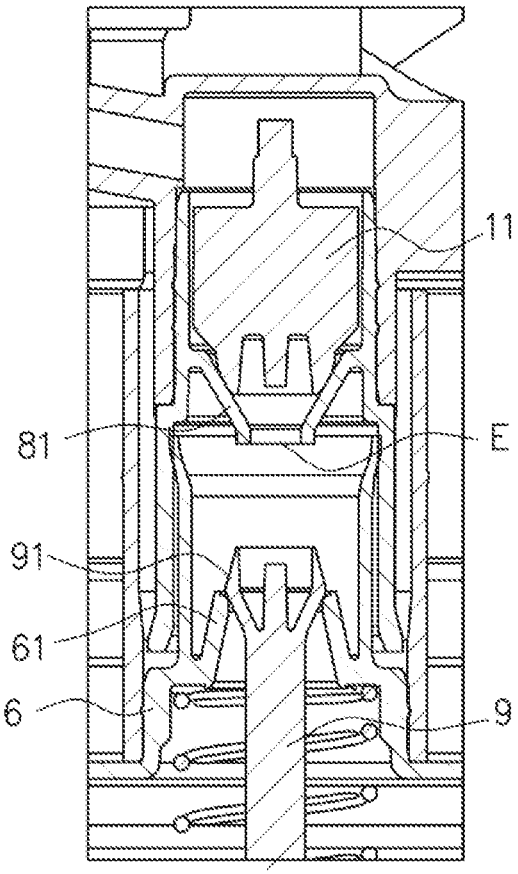
FIG. 5 illustrates diagrams (A) and (B) showing a final stage in a sucking-up state of the trigger-type pump dispenser A according to the embodiment of the present invention, (A) showing the beginning of a crimping stage, (B) showing the end of the crimping stage.
Figure 5B:
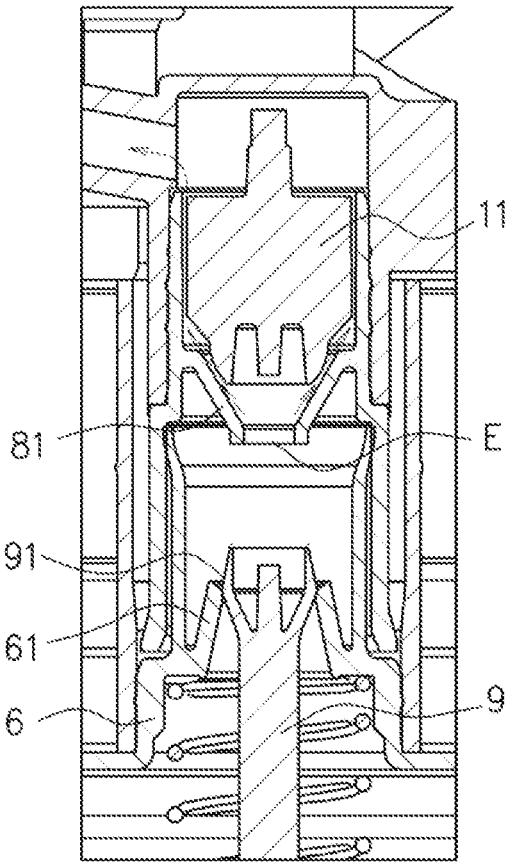

This final stage is shown in FIG. 5.

FIG. 5 illustrates diagrams (A) and (B) showing a final stage in a sucking-up state of the trigger-type pump dispenser A according to the embodiment of the present invention, (A) showing the beginning of a crimping stage, (B) showing the end of the crimping stage.

However, since the piston structure 6 rises for a while even after the inside of the valve case has become sealed, a transition occurs from the state shown in (A) of FIG. 5 to the state shown in (B) of FIG. 5, with the result that pressure is applied to the liquid in the valve case.

This is because there are variations in sealing time due to the shape of the bulging portion 91.

Then, the free second valve valving element 11 moves up (that is, the second valve opens), and the liquid moves toward the nozzle.

However, since the through-hole diameter D1 is smaller than the nozzle orifice diameter D2, the liquid passes through the nozzle orifice N at a velocity which is lower than that at which the liquid passes through the through-hole E.

Further, since the through-hole diameter D1 is smaller than the nozzle orifice diameter D2, the aforementioned resistance to passage of the liquid makes it hard for the liquid to pass through the through-hole E.

Accordingly, the liquid does not vigorously flow toward the nozzle as has conventionally been the case, so that the liquid is prevented from vigorously squirting from the nozzle orifice N.

That is, a squirting phenomenon is avoided.

Again, by the way, as mentioned earlier, the trigger 3 has conventionally been required to be lightly operable, and for this reason, the through-hole diameter D1 of the second valve valving element 11 has been designed to be larger than the nozzle orifice diameter D2.

When the through-hole diameter D1 is thus larger than the nozzle orifice diameter D2, the liquid passes through the nozzle orifice N at a velocity which is higher than that at which the liquid passes through the through-hole E.

Further, since the liquid is subjected to low resistance at the through-hole E, the liquid easily passes through the through-hole E, moves rigorously, and ends up squirting from the nozzle orifice N (squirting phenomenon).

The present invention is intended to suppress a squirting phenomenon from the nozzle orifice N even at the cost of the easy operability required of such a trigger 3 to be lightly operable.

In the foregoing, a preferred embodiment of the present invention has been described. However, the present invention is not limited to the foregoing embodiment.

For example, FIG. 1 shows a state in which the adaptor 12 is attached to the conduit 10 attached to the lower part of the small-diameter cylinder portion 4B of the cylinder structure 4.

This adaptor 12 is a tubular body and has provided therein a thick bottom wall 12B having a bottom hole 12A, and the thick bottom wall 12B has a slope at a lower end thereof.

Accordingly, even when the conduit 10 bends in the middle and has its leading end located in a corner of the bottom of the vessel V, the liquid can be efficiently sucked up to the last drop.

Further, even in a case where the pump dispenser is removed from the vessel V for liquid replenishment or the like, greater surface tension generated because the bottom hole 12A is smaller than the inner diameter of the conduit 10 prevents the liquid from dripping from the conduit 10, so that the surroundings are not made dirty.

As long as the leak valve 9, the second valve valving element 11, and the mortar-shaped valve seat 81 are provided as in the case of the present invention, the shapes and structures of other components can be employed even when they are changed as appropriate.

INDUSTRIAL APPLICABILITY

The present invention is applicable to fields such as paint industries in general or medical instruments, provided the principle of a trigger-type pump dispenser of the invention is utilized.

REFERENCE SIGNS LIST

1 . . . handle structure,

1A . . . handle portion,

1B . . . basal portion,
2 . . . nozzle base structure,
2A . . . nozzle portion,
2B . . . tubular basal portion,
3 . . . trigger,
31 . . . holding recessed portion,
32 . . . thumb supporting portion,
4 . . . cylinder structure,
4A . . . large-diameter cylinder portion,
4B . . . small-diameter cylinder portion,
4B1 . . . lower hole,
4B2 . . . lower valve seat,
5 . . . cap,
6 . . . piston structure,
6A . . . large-diameter piston portion,
6B . . . small-diameter piston portion,
61 . . . inverted-mortar-shaped lip,
62 . . . columnar protrusion,
7 . . . spring,
8 . . . valve case,
81 . . . mortar-shaped valve seat,
9 . . . leak valve,
9A . . . bottom part,
91 . . . bulging portion,
92 . . . regulatory frame,
10 . . . conduit,
11 . . . second valve valving element,
12 . . . adaptor,
12A . . . bottom hole,
12B . . . thick bottom wall,
A . . . trigger-type pump dispenser,
V . . . vessel,
E . . . through-hole,
N . . . nozzle orifice

The invention claimed is:

1. A trigger-type pump dispenser comprising:
a handle structure;
a nozzle base structure attached to the handle structure;
a trigger attached to the handle structure;
a cylinder structure attached to the handle structure;
a cap by which the cylinder structure is held down and attached to a mouth of a vessel;
a piston structure that slides inside the cylinder structure;
an inverted-mortar-shaped lip formed in the piston structure;
a spring that springs the piston structure;
a valve case attached to the nozzle base structure;
a mortar-shaped valve seat formed in the valve case;
a leak valve, attached to a bottom part of the cylinder structure, that has a bulging portion at a tip thereof;
a first valve; and
a second valve,
wherein
a movement of the piston structure from top dead center to bottom dead center causes liquid in the cylinder structure to be discharged from a nozzle orifice,
the bulging portion at the tip of the leak valve is disposed to pass through the inverted-mortar-shaped lip, and
a through-hole diameter of the mortar-shaped valve seat of the valve case is smaller than a nozzle orifice diameter.

2. The trigger-type pump dispenser according to claim 1, wherein the inverted-mortar-shaped lip is set to be crimped onto the bulging portion at the tip of the leak valve immediately before the piston structure reaches top dead center.

3. The trigger-type pump dispenser according to claim 1, wherein
Through-hole diameter D1<Nozzle orifice diameter D2,
D1 ranges from 2 mm to 6 mm, and
D2 ranges from 3 mm to 8 mm.

4. The trigger-type pump dispenser according to claim 1, wherein
a conduit is attached to a lower part of a small-diameter cylinder portion of the cylinder structure, and
an adaptor is attached to a lower end of the conduit by press fitting.

5. The trigger-type pump dispenser according to claim 4, wherein
the adaptor is a tubular body and has provided therein a thick bottom wall having a bottom hole, and
the thick bottom wall has a slope at a lower end thereof.

* * * * *